US011219339B2

(12) United States Patent
Kennedy

(10) Patent No.: US 11,219,339 B2
(45) Date of Patent: Jan. 11, 2022

(54) LOOSE HAIR COLLECTION DEVICE

(71) Applicant: Whitney L Kennedy, Peachtree City, GA (US)

(72) Inventor: Whitney L Kennedy, Peachtree City, GA (US)

( * ) Notice: Subject to any disclaimer, the term of this patent is extended or adjusted under 35 U.S.C. 154(b) by 272 days.

(21) Appl. No.: 16/375,957

(22) Filed: Apr. 5, 2019

(65) Prior Publication Data

US 2020/0315407 A1 Oct. 8, 2020

(51) Int. Cl.

| | |
|---|---|
| ***A47K 5/18*** | (2006.01) |
| ***A45D 44/16*** | (2006.01) |
| ***A47K 7/02*** | (2006.01) |
| ***A46B 5/00*** | (2006.01) |
| *H04R 1/44* | (2006.01) |

(52) U.S. Cl.

CPC ..... *A47K 5/18* (2013.01); *A45D 44/16* (2013.01); *A46B 5/0075* (2013.01); *A47K 7/02* (2013.01); *A46B 2200/405* (2013.01); *A47K 2201/02* (2013.01); *H04R 1/44* (2013.01)

(58) Field of Classification Search

CPC . A47K 5/18; A47K 7/02; A47K 7/024; A47K 7/04; A47K 3/281; A45D 44/16; A46B 5/0054; A46B 5/0062; A46B 5/0075; A46B 5/0079; A46B 2200/405

See application file for complete search history.

(56) References Cited

U.S. PATENT DOCUMENTS

| | | | | |
|---|---|---|---|---|
| 3,040,337 | A * | 6/1962 | Fjelstad | A47K 7/024 4/559 |
| 5,479,951 | A * | 1/1996 | Denebeim | A45D 2/2478 132/120 |
| 6,053,464 | A | 4/2000 | Cardarelli | |
| 6,109,214 | A | 8/2000 | Rampersad | |
| 7,100,238 | B2 * | 9/2006 | McCauley | A46B 5/0062 15/144.1 |
| 7,407,142 | B1 * | 8/2008 | Lopez | A45D 44/16 248/205.2 |
| 8,151,481 | B2 * | 4/2012 | Perez, Jr. | A45D 20/14 34/96 |
| 9,112,993 | B1 * | 8/2015 | Rivera | H04M 1/6033 |
| 9,131,810 | B2 * | 9/2015 | Reile | A47K 3/281 |
| 9,370,281 | B2 * | 6/2016 | Harewood | A47K 7/043 |
| 2002/0066151 | A1 * | 6/2002 | Parker | A46B 5/0079 15/172 |
| 2010/0175213 | A1 * | 7/2010 | Fitzwater | A47K 7/024 15/160 |

* cited by examiner

*Primary Examiner* — Laura C Guidotti
(74) *Attorney, Agent, or Firm* — Mehrman Law Office; Michael J. Mehrman

(57) ABSTRACT

A loose hair collection device that attaches to the shower wall for collecting lost hair while a person with long hair takes a shower. The device includes a pair of bristle pads that can be selectively disposed in a side-by-side (vertical) position, in an shelf ("L") position, or in a face-to-face ("U") position. A flex connector restrains the bristle pads in these positions without additional support. The face-to-face position facilitates collection of loose hair, the shelf positions provides a soap holder, while the side-by-side position facilitates cleaning of the collected loose hair from the device. The device may also include a water-tight pouch for holding a mobile device, or a speaker (and display screen if desired) and Bluetooth capability for wirelessly connecting to a mobile device locate outside the shower.

16 Claims, 6 Drawing Sheets

LOOSE HAIR COLLECTION DEVICE

TECHNICAL FIELD

The present invention is directed to human grooming devices and, more particularly, to a loose hair collection device for collecting lost hair while a person with long hair takes a shower.

BACKGROUND

Those with long hair are quite familiar with the problems that can result from the loss of long hair in the shower. The lost hair can be difficult to collect, become stuck to the shower wall and collect in the drain. Eventually the lost hair can cause the shower floor to remain wet long after showering, which results in soap scum building up on the shower floor and clogging the drain pipe. There is no device currently available to conveniently solve this problem. There is, therefore, a continuing need for a loose hair collection device for collecting lost hair while a person with long hair takes a shower.

SUMMARY

The present invention may be embodied in a loose hair collection device that attaches to the shower wall for collecting lost hair while a person with long hair takes a shower. The device includes a pair of bristle pads that can be selectively disposed in a side-by-side (vertical) position, in an shelf ("L") position, or in a face-to-face ("U") position. A flex connector restrains the bristle pads in these positions without additional support. The face-to-face position facilitates collection of loose hair, the shelf positions provides a soap holder, while the side-by-side position facilitates cleaning of the collected loose hair from the device. The device may also include a water-tight pouch for holding a mobile device, or a speaker (and display screen if desired) and Bluetooth capability for wirelessly connecting to a mobile device locate outside the shower.

It will be understood that specific embodiments may include a variety of features in different combinations, as desired by different users. The specific techniques and structures for implementing particular embodiments of the invention and accomplishing the associated advantages will become apparent from the following detailed description of the embodiments and the appended drawings and claims.

BRIEF DESCRIPTION OF THE FIGURES

The numerous advantages of the invention may be better understood with reference to the accompanying figures in which.

DETAILED DESCRIPTION

The present invention may be embodied in a loose hair collection device that attaches to the shower wall for collecting lost hair while a person with long hair takes a shower. The device includes a pair of bristle pads that can be selectively disposed in a side-by-side (straight or vertical) configuration, in an shelf ("L") configuration, or in a face-to-face ("U") configuration. The face-to-face configuration facilitates collection of loose hair, the shelf configuration provides a soap holder, while the side-by-side configuration facilitates cleaning of the collected loose hair from the device.

Figure 1C:
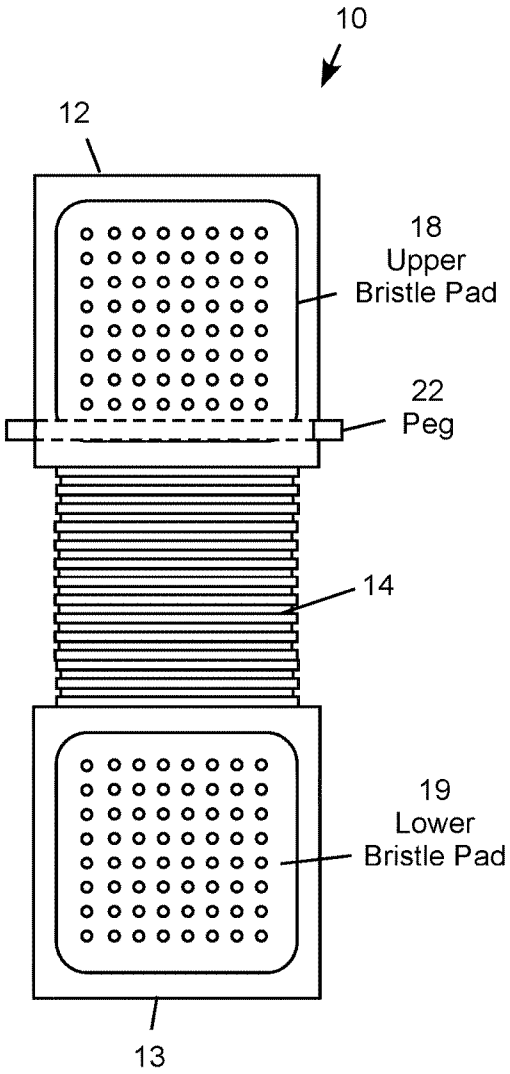
FIG. 1C is a conceptual front view illustration of the loose hair collection device.
Figure 1B:
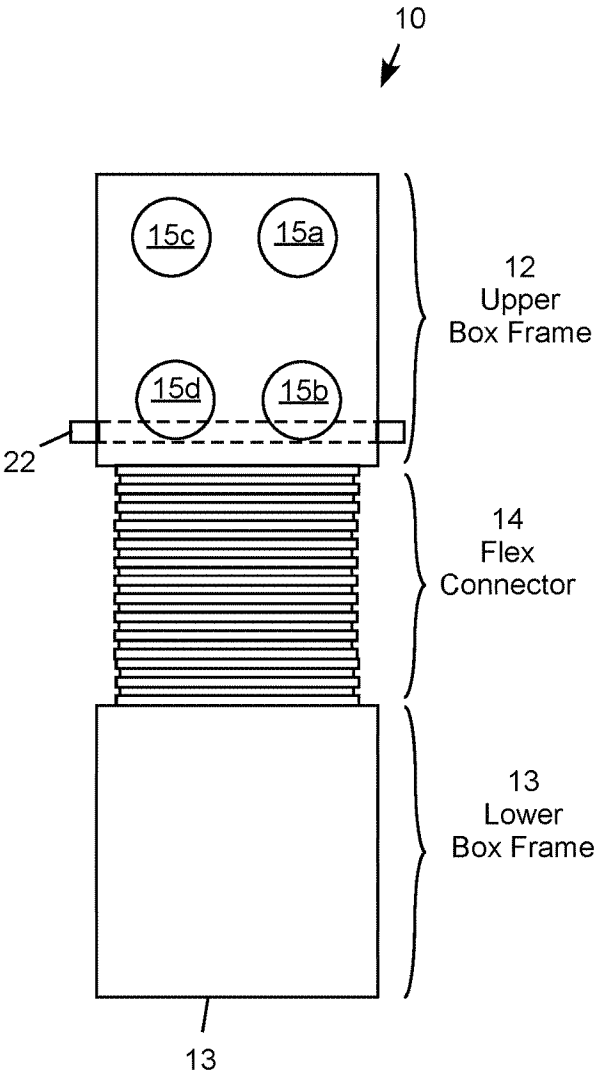
FIG. 1B is a conceptual rear view illustration of the loose hair collection device.
Figure 1A:
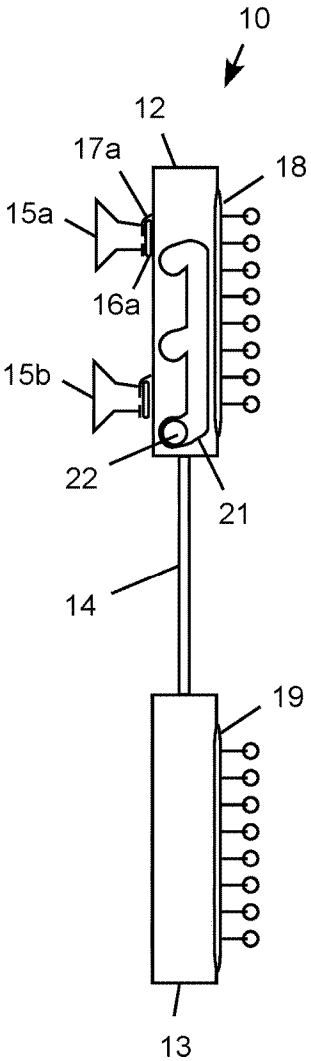
FIG. 1A a conceptual side view illustration of a loose hair collection device.

FIG. 1A is a conceptual side view, FIG. 1B is a conceptual rear view, and FIG. 1C is a conceptual front view illustration of a representative embodiment of a loose hair collection device 10, which includes an upper box frame 12 and a lower box frame 13 connected to each other by a flex connector 14. The upper box frame 12 carries or connects to four fasteners 15*a-d* that are used to connect the upper box frame to the shower wall. Referring to a representative fastener 15*a*, the fastener includes a knob 16*a* that removable slides into an open-bottom socket 17*a* on the back of the upper box frame 12. The upper box frame 12 carries an upper bristle pad 18 and the lower box frame 13 carries a lower bristle pad 19. FIGS. 1A-1C show the upper and lower bristle pads in the side-by-side (straight or vertical) configuration. The upper end of the flex connector 14 is fixed to the bottom of the upper box frame 12, while the lower end of the flex connector is fixed to the upper end of the lower box frame 13. This allows the lower box frame 13, which is free hanging, to be moved with respect to the upper box frame 12, which is attached to the shower wall, from the side-by-side (straight or vertical) configuration shown in FIGS. 1A-1C and FIG. 2 to the shelf ("L") configuration shown in FIG. 3A and the face-to-face ("U") configuration shown in FIG. 3B.

Figure 2:
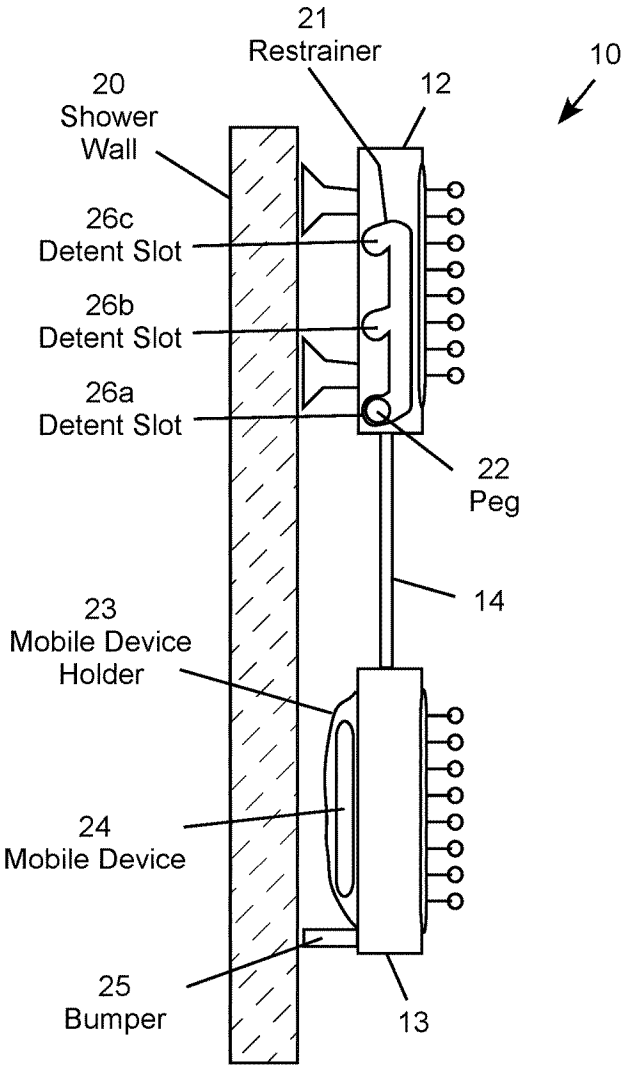
FIG. 2 is a conceptual side view illustration of the loose hair collection device with a flex connector in a straight configuration.
Figure 3B:
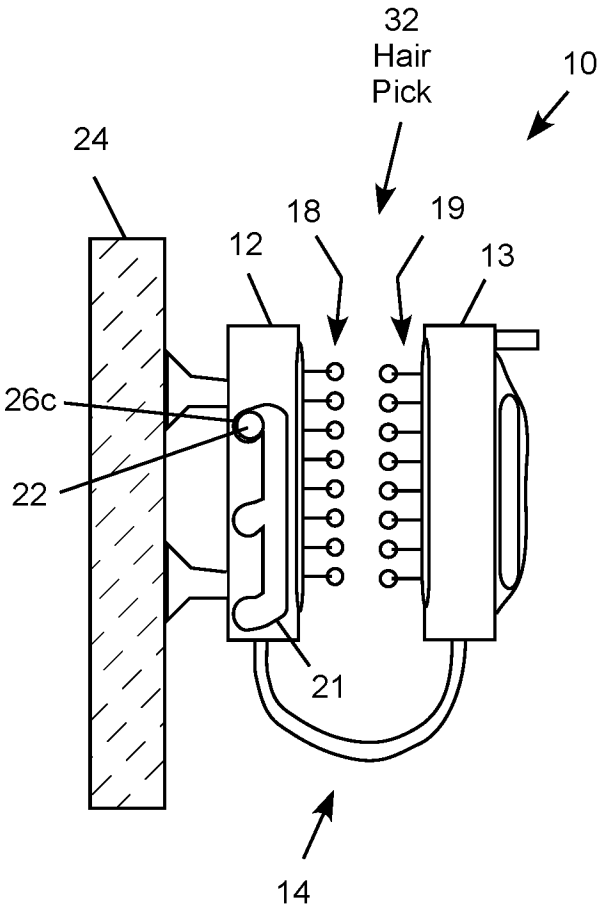
FIG. 3B is a conceptual side view illustration of the loose hair collection device with the flex connector in a face-to-face or "U" configuration.
Figure 3A:
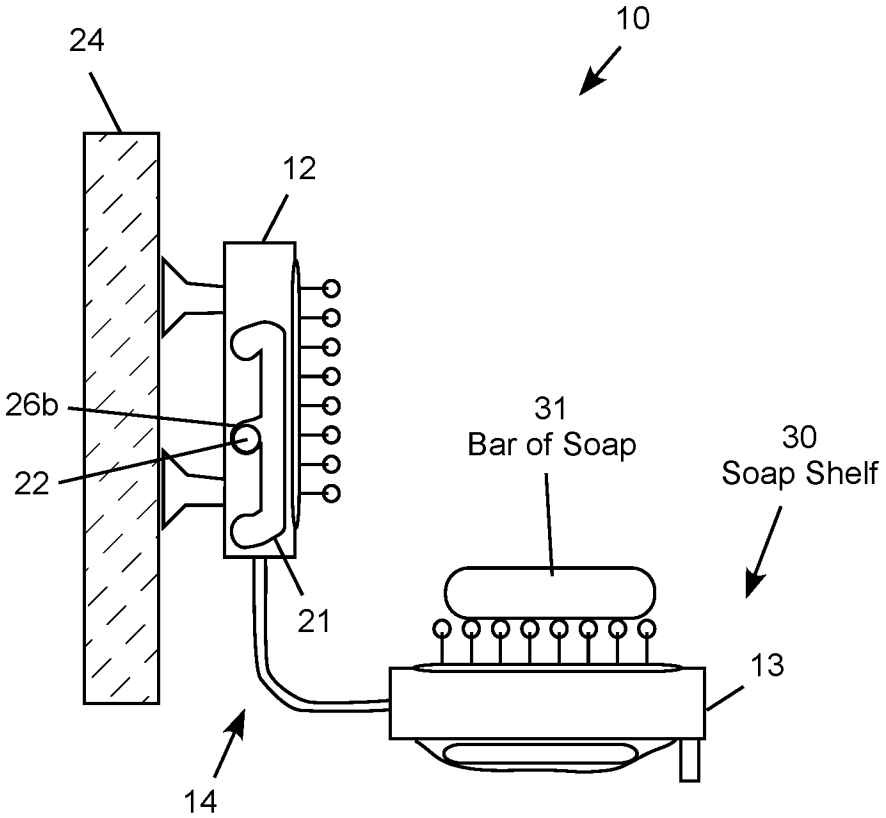
FIG. 3A is a conceptual side view illustration of the loose hair collection with the flex connector in a shelf or "L" configuration.

FIG. 2 is a conceptual side view illustration of the loose hair collection device 10 with the upper box frame 12 and the lower box frame 13 in the side-by-side (straight or vertical) configuration. FIG. 3A is a conceptual side view illustration of the loose hair collection device 10 with the upper box frame 12 and the lower box frame 13 in the shelf ("L") configuration. FIG. 3B is a conceptual side view illustration of the loose hair collection device 10 with the upper box frame 12 and the lower box frame 13 in the face-to-face ("U") configuration. The upper box frame 12 includes a pair of restrainers 21 (the restrainer in one side of the upper box frame 12 is shown in FIG. 2 and FIGS. 3A and 3B) that removably support a peg 22 that is attached to the top side of the flex connector 14. In this embodiment, the restrainers 21 are open slots through the side walls of the upper box frame. The peg 22 extends through restrainers 21 on both sides of the upper box frame 12. The restrainers 21 include three detent slots 26*a-c* in which the peg 22 can be placed to retain the tops of a pair of strings or ribbons of the flex connector 14 at three different levels. The lower detent slot 26*a* holds the peg 22 at a lower level corresponding to the side-by-side (straight or vertical) configuration shown in FIG. 2. The middle detent slot 26*b* holds the peg 22 at a middle level corresponding to the shelf ("L") configuration shown in FIG. 3A. And the upper detent slot 26*c* holds the peg 22 at an upper level corresponding to the face-to-face ("U") configuration shown in FIG. 3B.

Figure 5B:
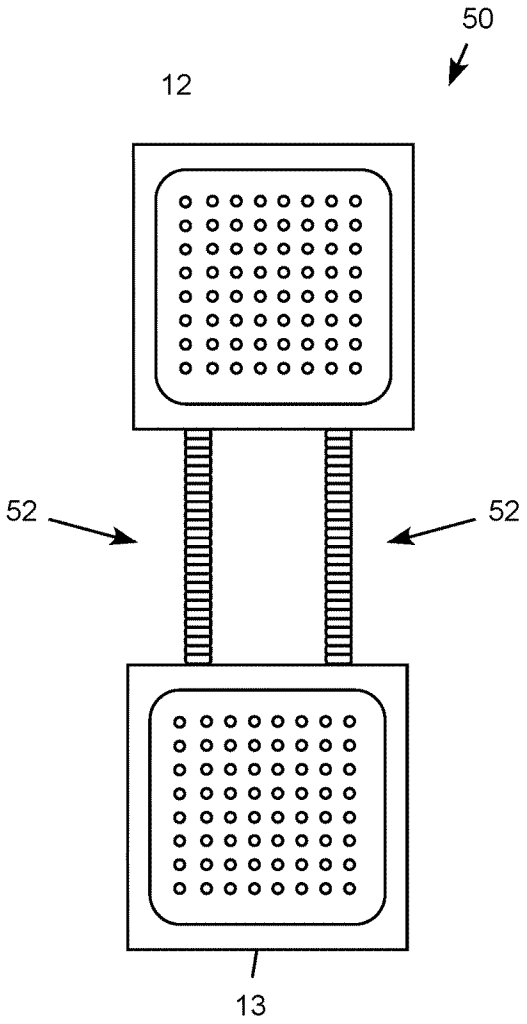
FIGS. 5A-5D are conceptual illustrations of an alternative embodiment of the loose hair collection device.
Figure 5A:
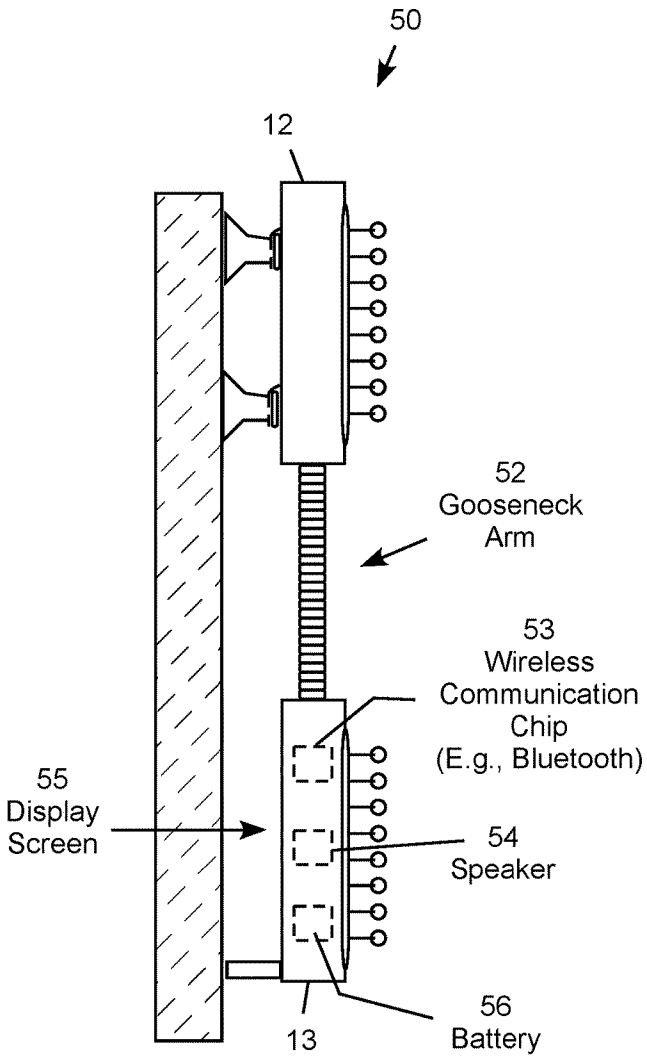
Figure 5D:
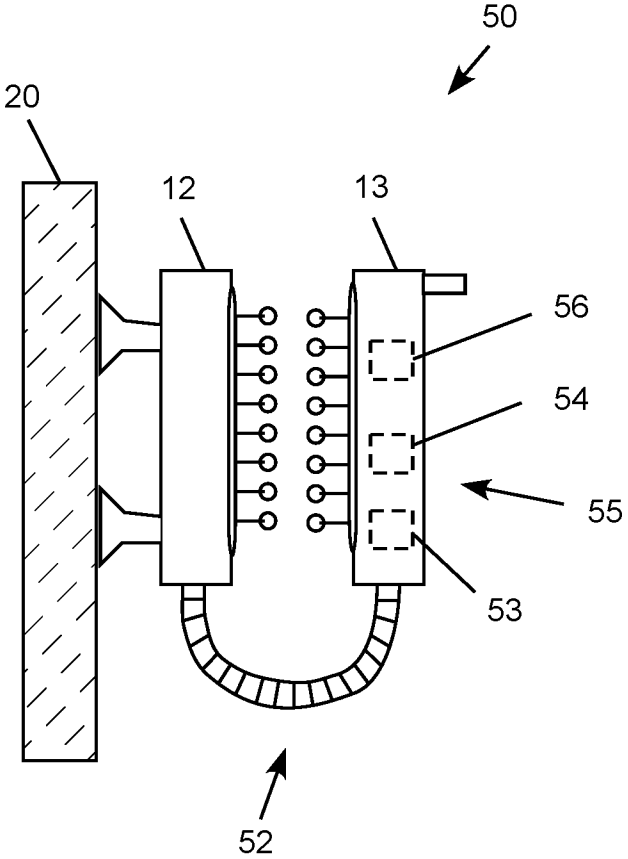
Figure 5C:
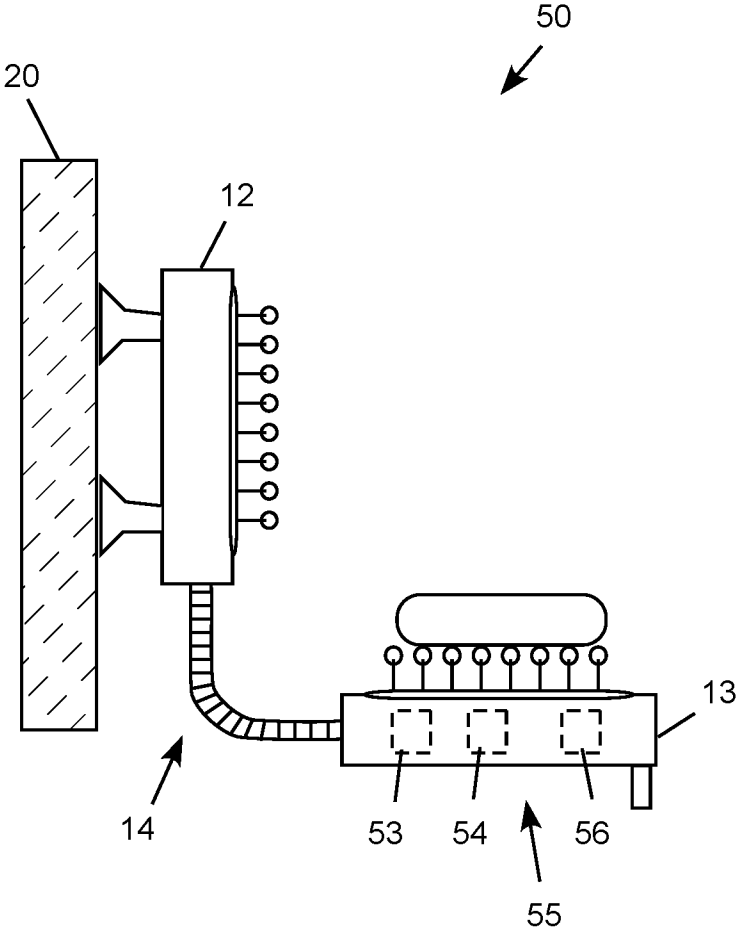

This embodiment also includes a water-tight zippered pouch 23 that may serve as a mobile device holder into which the user may place a mobile device 24, such as a smartphone, iPod® or wireless speaker to allow the user to listen to music or other programming while using the shower. The lower box frame 13 includes a bumper 25 that keeps the pouch 23 from banging into the shower wall 20. As an alternative, the device 10 may include an onboard speaker (and a display screen if desired) and Bluetooth capability so that users can pair their phones to the speaker (and display screen if desired) without placing the phone itself into the shower (see FIGS. 5A-5C).

The shelf or "L" position allows the lower box frame 13 to be used as soap shelf 30 for a bar of soap 31. Similarly, when the flex connector 14 is dropped down to the bottom position of the restrainer 21, the flex connector 14 is long enough to allow the lower box frame 13 to be moved into the face-to-face or "U" position with respect to the box frame 12 as shown in FIG. 3B. More specifically, the flex connector 14 can be manually positioned in a straight configuration to support the lower box frame 13 in the side-by-side position with respect to the upper box frame 12 as shown in FIG. 2A, in which the bristle pads 18 and 19 face in a common direction. The flex connector 14 can also be manually positioned in an "L" configuration to support the lower box frame 13 perpendicular to the upper box frame 12 as shown in FIG. 3A, in which the bristle pads 18 and 19 are perpendicular to each other. Similarly the flex connector 14 can also be manually positioned in a "U" configuration to support the lower box frame 13 in the face-to-face position with respect to the upper box frame 12 as shown in FIG. 3B, in which the bristle pads 18 and 19 face each other to create the hair pick 32. The face-to-face or "U" position allows the bristles 18, 19 to form a hair pick 32 that a user may run his or her hand through to remove loose hairs from the hand onto the hair pick. The face-to-face position may also be preferred when listening to music or viewing the display screen on the mobile device 24 held in the pouch 23.

Figure 4B:
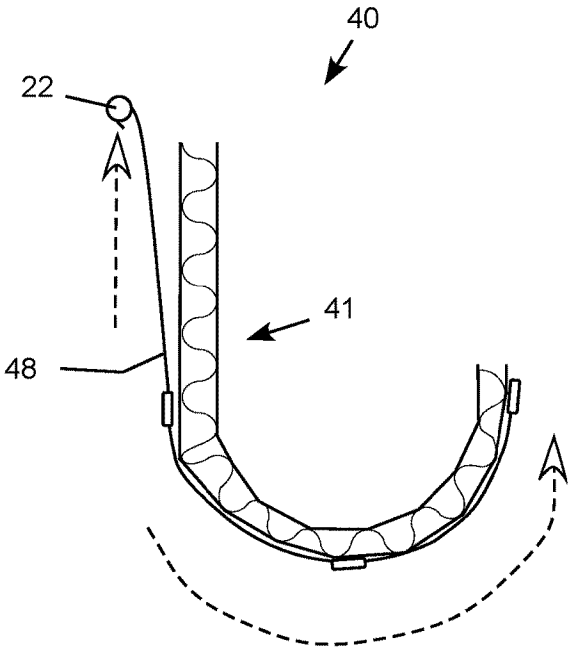
FIG. 4B is a conceptual side view illustration of the example flex connector in a face-to-face or "U" configuration.
Figure 4A:
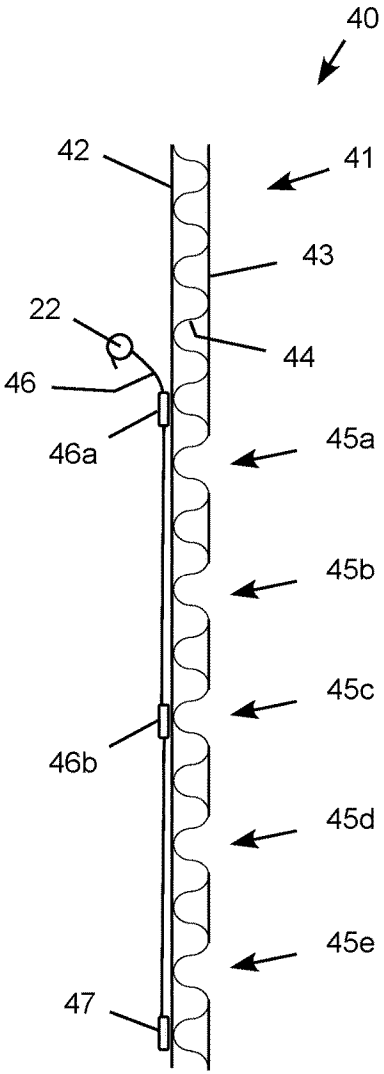
FIG. 4A is a conceptual side view illustration of an example flex connector in a straight configuration.

FIGS. 4A and 4B are a conceptual side view illustrations of a particular example of a flex connector 40 that is configured to selectively hold the lower box frame 13 in the side-by-side position, in the shelf or "L" position, or in the face-to-face or "U" position with respect to the upper box frame 12. The upper box frame 12 is attached to the shower wall, while the lower box frame 13 hangs freely from the upper box frame by way of the flex connector 40. The flex connector 40 supports the weight of the lower box frame 13 plus the typical weight of a bar of soap and a smartphone in the shelf or "L" position, and in the face-to-face or "U" position, without additional physical support.

The flex connector 40 is formed from a waterproof (e.g., plastic) modified corrugated board 41 that includes planar outer layers 42 and 43 on either side of a fluted center layer 44. The modified corrugated board 41 is similar to a conventional plastic corrugated board except that it has open strips 45*a*-45*e* on the bottom portion of the outer layers 43 that will away from the shower wall. The flex connector 40 also includes a number of strings or ribbons represented by the string 46. Typically two or three strings are spaced horizontally across modified the corrugated board 41. The representative string(s) 46 are fixed on its upper end to the peg 22, which is selectively held within the detent slots 26*a-c* of the restrainer 21 of the upper box frame 12. The string(s) 46 are also attached at or near the bottom of the corrugated board 41, for example by way of a bottom anchor 47 that is attached at or near the bottom of the corrugated board. The string(s) 46 also slide through a number of intermediate supports represented by the supports 46*a* and 46*b*. This configuration allows the lower section of the modified corrugated board 41 to curl when the peg 22, and thus the top of the string(s) 46, are moved upward as shown in FIG. 4B. The configuration thus allows the flex connector 40 to be placed into a straight or vertical configuration to position the lower box frame 13 in a side-by-side configuration with respect to the upper box frame 12 when the peg 22 (and thus the top of the string(s) 46) is manually placed in the lower detent slot 26*a* as shown in FIG. 2. Similarly, the flex connector 40 can be placed into the shelf or "L" configuration to position the lower box frame 13 in a perpendicular configuration with respect to the upper box frame 12 when the peg 22 (and thus the top of the string(s) 46) is manually placed in the center detent slot 26*b* as shown in FIG. 3A. And the flex connector 40 can be placed into the face-to-face or "U" configuration to position the lower box frame 13 in a face-to-face configuration with respect to the upper box frame 12 when the peg 22 (and thus the top of the string(s) 46) is manually placed in the upper detent slot 26*c* as shown in FIG. 3B.

In an alternative embodiment, an equivalent of the string (s) 46 may be attached to the upper box frame 12, while an equivalent of the peg 22 may be attached to the top of the modified corrugated board 41. This allows the top portion of the modified corrugated board 41 to move up and down within the upper box frame 12, while the top(s) of the string(s) 46 are fixed. This configuration allows the lower section of the modified corrugated board 41 to curl when the peg 22, and thus the top of the modified corrugated board 41, is moved downward. As a result, the flex connector 40 can be placed into the straight or vertical configuration to position the lower box frame 13 in a side-by-side configuration with respect to the upper box frame 12 when the peg 22 (and thus the top of modified corrugated board 41) is manually placed in the upper detent slot 26*c*. Similarly, the flex connector 40 can be placed into the shelf or "L" configuration to position the lower box frame 13 in a perpendicular configuration with respect to the upper box frame 12 when the peg 22 (and thus the top of modified corrugated board 41) is manually placed in the center detent slot 26*b*. And the flex connector 40 can be placed into the face-to-face or "U" configuration to position the lower box frame 13 in the face-to-face configuration with respect to the upper box frame 12 when the peg 22 (and thus the top of modified corrugated board 41) is manually placed in the lower detent slot 26*a*.

In a particular embodiment, each box frame 12, 13 may be a 6-inch by 6-inch hollow plastic block, and the plastic flex connector 14 may be a 5-inch wide by 5-inch long corrugated plastic board modified to allow the board to flex as shown in FIGS. 3A-3B. Other suitable types of flex connectors may also be utilized. In addition, the fasteners 15*a-d* may be 1-inch diameter suction cups with bottom anchors that removably slide into the open-bottom sockets on the back of the upper box frame 12. While other types of fasteners may be used, the suction cups are advantageous because they do not damage or require permanent alteration of the shower wall. Command strips may also be utilized instead of or in addition to the suction cups. The bristle pads 18 and 19 may be similar to coarse bristles hair brushes or hair picks.

FIGS. 5A-5D are conceptual illustrations of an alternative loose hair collection device 50. This embodiment is similar to the loose hair collection device 10 described above with several modifications. In this alternative, the upper box frame 12 is connected to the lower box frame 13 by a pair of gooseneck arms 52, such as those typically used in lighting and musical applications (e.g., a "musician's gooseneck" used to position a light on a sheet-music stand). Alternatively, the flex connector may include a different number of gooseneck arms, such as one gooseneck arm, three gooseneck arms, four gooseneck arms, or more as a matter of design choice. Instead of a pouch for holding a mobile device, the loose hair collection device 50 includes a wireless communications chip (e.g., Bluetooth) 53, a speaker 54 and an optional display 55, which are all powered by an onboard battery 56. These features allow the user to link a mobile communication device, such as a smartphone, located outside the shower to the loose hair collection device 50 to play music or other programming inside the shower.

It will therefore be appreciated that the present invention provides significant improvements in loose hair collection devices. The foregoing relates only to the exemplary embodiments of the present invention, and that numerous changes may be made therein without departing from the spirit and scope of the invention as defined by the following claims.

The invention claimed is:

1. A loose hair collection device, comprising:

an upper box frame comprising a first side carrying one or more fasteners for removably attaching the upper box frame to a shower wall, the upper box frame further comprising a second side opposing the first side carrying a first bristle pad;

a lower box frame comprising a first side and a second side opposing the first side carrying a second bristle pad;

a flex connector connecting the upper box frame to the lower box frame; wherein the flex connector is selectively movable into a straight configuration in which the lower box frame is in a side-by-side position with respect to the upper box frame with the first and second bristle pads facing in a common direction;

wherein the flex connector is also selectively movable into an "L" configuration in which the first and second bristle pads face perpendicular to each other;

wherein the flex connector is also selectively movable into a "U" configuration in which the first and second bristle pads face each other; and wherein the upper box frame further comprises a restrainer for selectively restraining the flex connector in the "L" and "U" positions.

2. The loose hair collection device of claim 1, wherein the restrainer comprises a pair of slots through the upper box frame.

3. The loose hair collection device of claim 2, wherein:

the flex connector further comprises a peg connected to a top edge of the flex connector;

the restrainer comprises multiple detent slots;

the peg of the flex connector extends through the restrainer; and the detent slots are configured to selectively receive the peg.

4. The loose hair collection device of claim 3, wherein the peg may be selectively positioned in a first detent slot to restrain the flex connector in the "U" configuration.

5. The loose hair collection device of claim 4, wherein the peg may be selectively positioned in a second detent slot to restrain the flex connector in the "L" configuration.

6. The loose hair collection device of claim 5, wherein the peg may be selectively positioned in a third detent slot to restrain the flex connector in the straight configuration.

7. The loose hair collection device of claim 1, wherein the flex connector comprises:

a modified corrugated board;

a string having an upper end attached to the upper box frame and a lower end connected to a lower end of the modified corrugated board;

wherein movement of the modified corrugated board downward with respect to the upper box frame causes the modified corrugated board to curl to transition the modified corrugated board from the straight configuration to the "U" configuration.

8. The loose hair collection device of claim 1, wherein the first side of the lower box frame carries a water-tight zippered pouch configured to removably hold a mobile communication device.

9. The loose hair collection device of claim 1, wherein the one or more fasteners comprise one or more suction cups.

10. The loose hair collection device of claim 1, wherein the flex connector comprises one or more gooseneck arms.

11. The loose hair collection device of claim 10, wherein the flex connector comprises a pair of gooseneck arms.

12. The loose hair collection device of claim 1, further comprising a battery, a wireless communication device powered by the battery, and a speaker powered by the battery.

13. The loose hair collection device of claim 12, further comprising a display screen powered by the battery.

14. A loose hair collection device, comprising:

an upper box frame comprising a first side carrying one or more fasteners for removably attaching the upper box frame to a shower wall, the upper box frame further comprising a second side opposing the first side carrying a first bristle pad;

a lower box frame comprising a first side and a second side opposing the first side carrying a second bristle pad;

a flex connector connecting the upper box frame to the lower box frame; wherein the flex connector is selectively movable into a straight configuration in which the lower box frame is in a side-by-side position with respect to the upper box frame with the first and second bristle pads facing in a common direction;

wherein the flex connector is also selectively movable into an "L" configuration in which the first and second bristle pads face perpendicular to each other;

wherein the flex connector is also selectively movable into a "U" configuration in which the first and second bristle pads face each other;

wherein the upper box frame further comprises a restrainer for selectively restraining the flex connector in the "L" and "U" positions;

wherein the flex connector comprises a modified corrugated board and a string having an upper end attached to the upper box frame and a lower end connected to a lower end of the modified corrugated board, wherein movement of the modified corrugated board downward with respect to the upper box frame causes the modified corrugated board to curl to transition the modified corrugated board from the straight configuration to the "U" configuration.

15. The loose hair collection device of claim 14, wherein the restrainer comprises a pair of slots through the upper box frame.

16. The loose hair collection device of claim 15, wherein:

the flex connector further comprise a peg connected to a top edge of the modified corrugated board;

the restrainer comprises multiple detent slots;

the peg of the flex connector extends through the restrainer; and the detent slots are configured to selectively receive the peg.

* * * * *